US005740712A

United States Patent [19]

Watkins et al.

[11] Patent Number: 5,740,712

[45] Date of Patent: Apr. 21, 1998

[54] PUNCHING DEVICES

[75] Inventors: Stephen Christopher Watkins, Redditch; Geoffrey Felton, Stourport-on-Severn, both of United Kingdom

[73] Assignee: Acco-Rexel Group Services plc., United Kingdom

[21] Appl. No.: 840,262

[22] Filed: Apr. 14, 1997

Related U.S. Application Data

[63] Continuation of Ser. No. 341,575, filed as PCT/GB92/02106, Nov. 13, 1992, published as WO93/24289, Dec. 9, 1993, abandoned.

[30] Foreign Application Priority Data

May 27, 1992 [GB] United Kingdom ..... 9211191

[51] Int. Cl.[6] ..... B26F 1/04; B26F 1/14

[52] U.S. Cl. ..... 83/549; 83/563; 83/571; 83/618; 83/622; 83/629; 83/633; 83/687; 83/691; 412/38

[58] Field of Search ..... 83/687, 691, 549, 83/550, 551, 563, 618, 619, 622, 624, 629, 633, 571, 698.91; 234/43, 44, 38; 412/38, 39, 40, 41, 42, 43

[56] References Cited

U.S. PATENT DOCUMENTS

| | | | |
|---|---|---|---|
| 1,825,180 | 9/1931 | Copple | 83/620 |
| 2,568,863 | 9/1951 | May . | |
| 2,957,380 | 10/1960 | Duncan et al. . | |
| 2,985,052 | 5/1961 | Mentzer et al. . | |
| 3,263,538 | 8/1966 | Gobel et al. . | |
| 3,699,596 | 10/1972 | Lyon | 83/549 |
| 3,967,336 | 7/1976 | Cutter . | |
| 4,008,501 | 2/1977 | Cutter | 83/549 |
| 4,079,647 | 3/1978 | Elder et al. | 83/622 |
| 4,611,520 | 9/1986 | Terracciano | 83/549 |
| 4,645,399 | 2/1987 | Scharer | 83/549 |
| 5,044,242 | 9/1991 | Chiang . | |
| 5,090,859 | 2/1992 | Nanos et al. . | |
| 5,143,502 | 9/1992 | Kaufmann et al. | 83/549 |
| 5,163,350 | 11/1992 | Grosith, III et al. | 83/549 |

FOREIGN PATENT DOCUMENTS

| | | |
|---|---|---|
| 0 067 973 A3 | 12/1982 | European Pat. Off. . |
| 0 212 846 | 7/1986 | European Pat. Off. . |
| 2 139 542 | 11/1984 | United Kingdom . |
| WO 91/01224 | 2/1991 | WIPO . |

*Primary Examiner*—Eugenia Jones
*Assistant Examiner*—Charles Goodman
*Attorney, Agent, or Firm*—Kirschstein, et al.

[57] ABSTRACT

A punching device comprises a housing carrying a main punch body in the form of a plate mounted for rectilinear sliding movement, the punch body comprising a driving rack extending downwardly along each side, and a plurality of integral punch members projecting downwardly in a staggered array, the punch members being waisted. The device comprises an operating handle pivotally mounted on the housing carrying drive pinions engageable with the racks, so that by movement of the handle, the punch body may be raised and lowered. The punch body additionally carries auxiliary punch members, each being mounted on the punch body for longitudinal sliding movement relative thereto. Associated with each auxiliary punch member is a locking device, comprising a locking member which is movable between an inoperative position in which the auxiliary punch member is capable of longitudinal sliding movement relative to the punch plate, and an operative position in which the auxiliary punch member moves with the punch body in a punching operation. In this way, one or more of the auxiliary punch members may be taken out of operation to enable a stack of sheets of relatively small size to be provided with apertures along one side edge, or the auxiliary punch members may be brought into operation for the punching of apertures of a stack of sheets of full size.

10 Claims, 4 Drawing Sheets

PUNCHING DEVICES

This is a continuation of application Ser. No. 08/341,575, filed as PCT/GB92/02106, published as WO93/24289, Dec. 9, 1993, now abandoned.

BACKGROUND OF THE INVENTION

This invention is concerned with improvements relating to punching devices.

Punching devices are in common use, to punch a row of holes along one edge of material, such as a stack of paper, to enable the stack to be bound together, such as by a comb binder or a wire binder.

Conventionally available machines comprise a support means upon which the material to be punched may be located, a punch mechanism comprising a body, and a plurality of punch members carried by the punch body, the support means being provided with apertures to receive the punch members on passage through the material, and means to move the punch body between a retracted position in which the punch members are spaced from the support means and an advanced position in which the punch members extend through the apertures.

Conventionally the apertures provided in the support means are such as to enable holes to be punched on the entire length of one edge of (e.g.) a stack of sheets of A3 paper, and difficulty is encountered when it is desired to utilise the device in relation to a stack of sheets of smaller size, e.g. A4 paper, since it is in general desirable that holes are not punched close to top and bottom edges of the stack of sheets.

SUMMARY OF THE INVENTION

According to this invention there is provided a punching device comprising:

(a) a support means upon which material to be punched may be located, (b) a punch mechanism comprising a body, and a plurality of punch members carried by the punch body, (c) the support means being provided with apertures to receive the punch members on passage through the material, and (d) means to move the punch body from a retracted position in which the punch members are spaced from the support means and an advanced position in which the punch members extend through the apertures, wherein at least one of the punch members (hereinafter referred to as being an auxiliary punch member) is mounted on the punch body for sliding movement relative thereto, said movement being longitudinal of the punch member locking means being provided in relation to said auxiliary punch member which is movable between an inoperative condition in which said auxiliary punch member is capable of longitudinal movement relative to the punch body in a retractive direction and an operative condition in which such movement is prevented.

In this manner, by locating said auxiliary punch member in an appropriate position in a longitudinal array of punch members, said auxiliary punch member may be utilised, where it is desired to provide a relatively long array of holes, by movement of the locking means into its operative condition, and may be "taken out" by movement of the locking means to its inoperative condition where it is desired to provide a shorter array of holes.

Preferably the locking means is resiliently urged, such as by spring means, into its operative condition, operative means being provided to permit the locking means to be moved to its inoperative condition.

Preferably said operative means is adapted for manual operation, such as by finger-operation.

Preferably the other (non-auxiliary) punch members are fixed in relation to the punch body, preferably being integral therewith, and preferably each auxiliary punch member is mounted on the punch body in such a manner that, on movement of the punch body towards its advanced position, said auxiliary punch member is carried initially towards material located by the support means, and thereafter remains stationary while the punch body continues to advance, producing movement of the auxiliary punch member relative to the punch body in a retractive direction.

Preferably the punch device comprises means whereby each auxiliary punch member when at rest adopts a lowermost position, preferably a position in which it is in line with the remainder of the punch members.

Preferably the locking means is provided by a member mounted for movement on the punch body, preferably for pivotal movement, between an inoperative position and an operative position in which it affords an abutment between the punch body and the auxiliary punch member, so that the auxiliary punch member moves in a unitary manner with the punch body, and the non-auxiliary punch members.

Preferably the punching device comprises a plurality of such auxiliary punch members, conveniently three.

According to this invention there is also provided a punching device comprising a punch plate comprising a body portion and a plurality of punch members integral with the body portion, the plate being provided with rack formations, the device comprising pinion means engageable with the rack formations to enable the punch plate to be moved in a punching operation.

Preferably the device also comprises non-integral punch members carried by the body portion.

Preferably spaced rack formations are provided adjacent opposite side edges of the punch plate, and advantageously the punching device comprises twin pinions which may be driven by power means, but which are conveniently rotated, to carry the punch plate to an advanced position, by a manually-operated handle.

Preferably the punch plate is mounted in guide means for linear sliding movement between retracted and advanced positions.

Preferably the punch members are tapered, having a waist portion which is narrower than an operative edge portion in at least one dimension, preferably two dimensions extending mutually at right angles.

In this manner the punch members, on being driven through a stack of sheets in a punching operation, may more readily be withdrawn through the sheets with reduced stiction.

Preferably the tapering from the waist portion is curvilinear.

According to this invention there is also provided a punch body carrying a plurality of punch members, the punch members being tapered, having a waist portion which is narrower than an operative edge portion in at least one dimension, preferably two dimensions, extending mutually at right angles.

Advantageously the punch body is in the form of a plate and some at least of the punch members are integral with the punch plate.

Preferably at least one of the punch members is mounted on the punch body for movement relative thereto.

There will now be given a detailed description, to be read with reference to the accompanying drawings, of a punching device which is the preferred embodiment having been selected for the purposes of illustrating the invention by way example.

DETAILED DESCRIPTION OF THE PREFERRED EMBODIMENT

Figure 1:
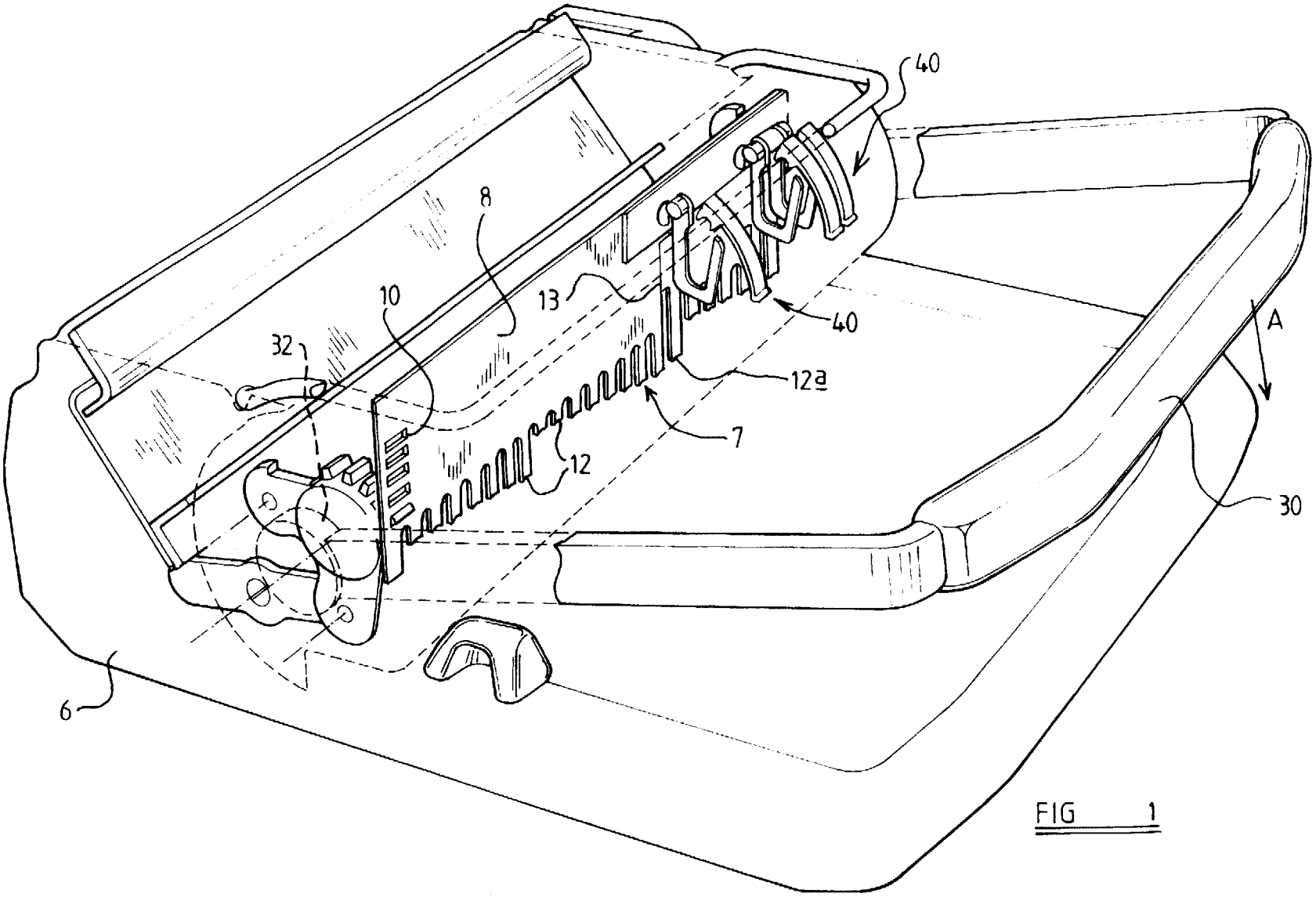
FIG. 1 is a perspective view of the device which is the preferred embodiment of the invention, parts thereof having been broken away for clarity.

The punching device which is the preferred embodiment of the invention comprises a housing 6 carrying a punch mechanism 7 comprising a main punch body 8 in the form of a plate for rectilinear sliding movement, the punch body comprising a driving rack 10 extending downwardly along each side, and a plurality of integral punch members 12 projecting downwardly in staggered array.

The punch body 8 is mounted above a support means 16, said support means providing a channel 18 in which a stack S of material such as sheets of paper may be located, a linear array of lower die apertures 20, and two linear arrays of superposed guide apertures 22 and 24, said three arrays of die apertures comprising one aperture in each array for each of the punch members 12 said apertures 20, 22 and 24 providing guide means for guiding the punch plate.

Figure 3:
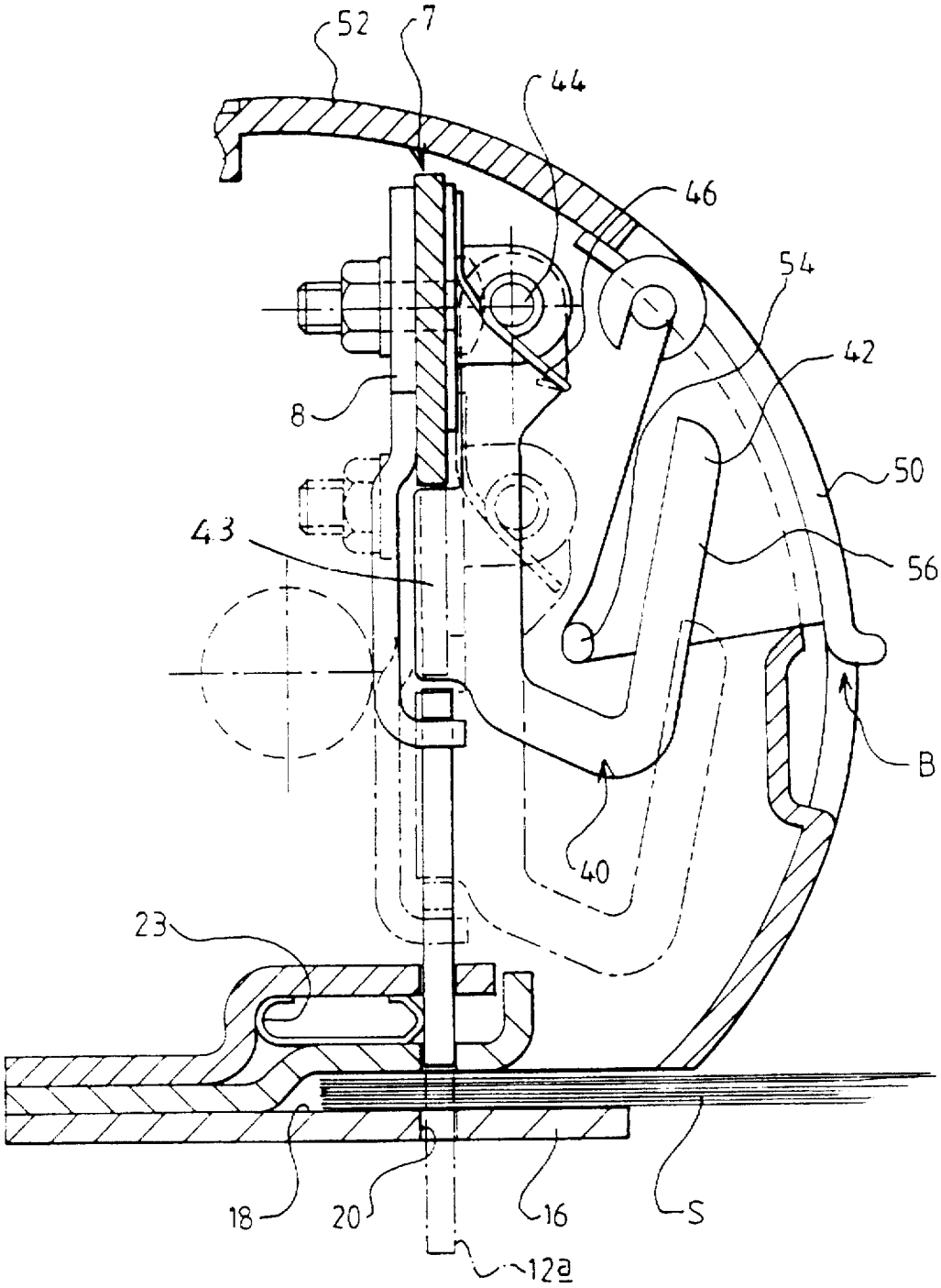
FIG. 3 is a view showing the locking means in an operative condition.

The device comprises an operating handle 30, pivotally mounted on the housing 6, and carrying drive pinions 32 engageable with the racks 10, so that by movement of the handle 30 in the direction of the arrow A of FIG. 1, the punch body 8 may be caused to move downwardly relative to the housing, between an upper, retracted position, shown in FIG. 1, and a lower, advanced position, shown in chain dotted lines in FIG. 3. Such movement of the operating member 30 causes the punch members to move within the guide apertures 22 and 24, through the stack of material S, and through the lower aperture 20, effecting the operation of punching a series of holes into the stack of paper.

The punch body additionally carries a plurality, specifically three, auxiliary punch members 12*a*, each of which being mounted on the main body 8 by a dovetail formation in a manner in which the punch member 12*a* is capable of sliding movement relative to the main body 8 along a longitudinal direction extending lengthwise of each punch member 12 and auxiliary punch member 12*a*. Each auxiliary punch member 12*a* is mounted on the main body 8 so that the respective auxiliary punch member 12*a* is free to fall under gravity into a rest position (shown in full lines in FIGS. 2 and 3) defined by engagement between a shoulder 13 of the punch member 12*a* and a finger 15 of the punch body in which it is retained in position in line with the remainder of the punch members 12.

Figure 2:
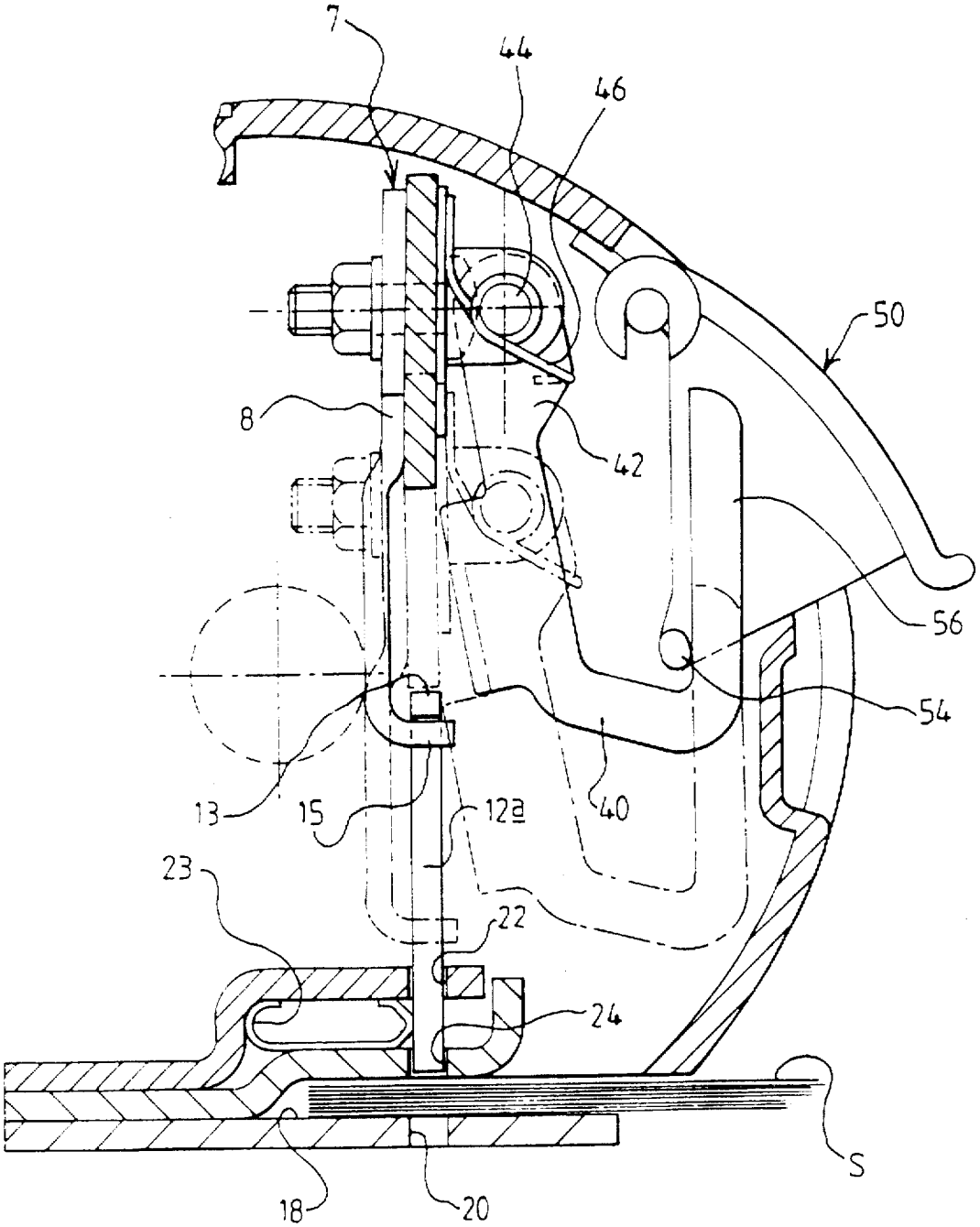
FIG. 2 is a sectional view showing the device in a condition preparatory to a punching operation, with a locking means in an inoperative condition.

Associated with each auxiliary punch member 12*a*, is a locking device 40, each locking device comprising a locking member 42 pivotally mounted on pivot 44 and movable between an inoperative position, shown in FIG. 2, and an operative position shown in FIG. 3, spring means 46 being provided to urge said locking members 42 to said operative position, in which an abutment 43 of the locking plate is interposed between the punch body 8 and the auxiliary punch member 12*a*, as is shown in FIG. 3, in a way such that on lowering of the punch body 8, the auxiliary punch acts as though it is solid with the punch body 8.

Each locking device 40 comprises an operating member 50 pivotally mounted on a casing 52 of the device, and which may be lifted by the insertion of a finger into a recess B to cause a pin 54 to engage behind an arm 56 of the plate 42, to move the locking device against the action of the spring 44 to its inoperative position.

The operating member 50 when in the retracted position shown in FIG. 2, corresponds to the associated auxiliary punch member being inoperative.

With the locking device inoperative, on lowering of the punch body 8 by use of the handle 30, the punch plate 8 and all of the punch members are lowered, a spring 23 preventing the auxiliary punch member from being carried downwardly into engagement with the stack S. On lifting of the punch body the auxiliary punch is engaged by the finger 15 and lifted. During such movement, the locking device is retained in its inoperative position, with the arm 56 riding against the pin 54.

However the spring 23 may be omitted, whereupon the auxiliary punch member 12*a* (when the locking member is in its inoperative position) will be carried into engagement with the stack S with the integral punch members 12, but will not exert any punching pressure thereon and will remain stationary while the integral punch members 12 pass through the stack in a punching operation, while any other auxiliary punch member 12*a* which is not in alignment with the stack S will pass through the apertures 22, 24, and 20 with the other punch members 12.

Thus, when the locking device is inoperative, the operating member 50 remains stationary relative to the housing while the punch mechanism moves between its retarded and advanced positions.

When it is desired to bring an auxiliary punch member into operation, the operating member 50 is pressed into the position shown in FIG. 3, the spring 46 causing the locking member 40 to move into its operative position, in which it fills the space between a downwardly facing shoulder 17 of the punch body and an upwardly-facing shoulder 13 of the auxiliary punch member, causing the auxiliary punch member to behave as a solid member with the punch body, so that as the punch body is lowered, the auxiliary punch member compresses the spring 23 and passes through the stack of sheets S and through the die aperture 20 in a punching operation.

In this way one or more auxiliary punch members 12*a* may be taken out of operation to enable a stack of sheets of relatively small size to be provided with apertures along one side edge, but being spaced appropriately from the top and bottom edges. Alternatively, for use with a stack of sheets of full size, the auxiliary punches may all be brought into operation.

Figure 4:
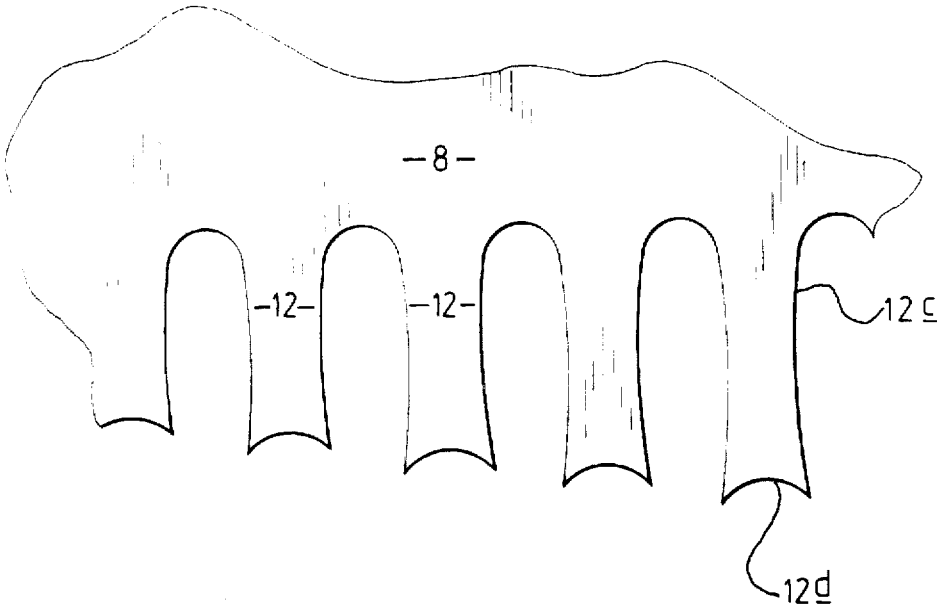
FIG. 4 is an enlarged view showing individual punch members of the device the "waisting" of the punch members thereof being shown in exaggerated form".

As is shown in FIG. 4, all of the punch members 12 and 12*a* are tapered, having a waist 12*c* which is narrower than the head 12*d* in at least the larger dimension (i.e. that dimension along the length of the row of punches, as is shown in FIG. 4) and advantageously optionally also in the perpendicular dimension. Preferably the tapering is as illustrated curvilinear in nature, although may of course be straight, enabling the punch members more readily to be withdrawn from a stack of sheets upon which a punching operation has been carried out, with reduced frictional forces.

The features disclosed in the foregoing description, or the accompanying drawings, expressed in their specific forms or in the terms or means for performing the desired function, or a method or process for attaining the disclosed result, may, separately or in any combination of such features, be utilised for realising the invention in diverse forms thereof.

We claim:

1. A device for punching holes in sheet material, comprising:

a) a housing including a support for supporting the sheet material to be punched, said support having a plurality of apertures;

b) a punch mechanism including a punch body mounted in the housing for movement along a longitudinal direction, said punch body including a plate and a plurality of elongated integral punch members of one-piece with the plate, each integral punch member extending lengthwise from the plate along the longitudinal direction away from the plate for joint constant movement with the body, said punch mechanism further including an elongated auxiliary punch member extending lengthwise along the longitudinal direction and being mounted in an unlocked condition on the body for movement relative to the body along the longitudinal direction; each of said integral punch members and said auxiliary punch member being aligned along the longitudinal direction with a respective one of said apertures;

c) means for selectively locking the body in a force-transmitting relationship with the auxiliary punch member in a locked condition; and d) means for moving the punch mechanism between a retracted position in which the integral punch members and the auxiliary punch member in the unlocked condition are spaced from the apertures, and an advanced position in which the integral punch members and the auxiliary punch member in the locked condition extend through the apertures to form holes in the sheet material.

2. The device according to claim 1, wherein the locking means includes a locking member having a movable locking plate, and wherein the auxiliary punch member is located at a spacing relative to the body in the unlocked condition; and further comprising operating means for selectively moving the locking plate into said spacing in the locked condition, and for moving the locking plate out of said spacing in the unlocked condition.

3. The device according to claim 2, wherein the auxiliary punch member has a first shoulder, and wherein the body has a second shoulder facing the first shoulder across said spacing, and wherein the locking plate engages both shoulders in the locked condition.

4. The device according to claim 2, wherein the locking member is pivotably mounted in the housing; and further comprising means for constantly urging the locking plate into said spacing.

5. The device according to claim 1; and further comprising guide openings in alignment along the longitudinal directional with a respective one of said apertures, and wherein each guide opening receives a respective one of the integral punch members and the auxiliary punch member.

6. The device according to claim 1, wherein the plate is elongated and extends between a pair of ends; and wherein the moving means includes a plurality of drive openings at each end of the plate, and a pair of drive pinions for drivingly engaging the drive openings.

7. The device according to claim 1, wherein the integral punch members are arranged along a linear row, and wherein the integral punch members extend over different distances along the longitudinal direction.

8. The device according to claim 1, wherein each integral punch member has a waist portion adjacent the plate, and terminates at an edge portion away from the plate; and wherein each integral punch member tapers outwardly in a transverse direction normal to said longitudinal direction as considered from the waist portion along the longitudinal direction to the edge portion.

9. The device according to claim 8, wherein each integral punch member is tapered along a curvilinear course.

10. The device according to claim 1; and further comprising additional auxiliary punch members mounted on the body for movement relative to the body along the longitudinal direction.

* * * * *